US005343943A

United States Patent [19]

Norris et al.

[11] Patent Number: 5,343,943

[45] Date of Patent: Sep. 6, 1994

[54] PORTABLE OIL-DRILLING WASTE RECOVERY SYSTEM

[76] Inventors: Jimmy D. Norris, 277 Burnham Rd., Oak View, Calif. 93022; Orville C. Hibdon, 88 West Crown, Ojai, Calif. 93023

[21] Appl. No.: 889,128

[22] Filed: May 26, 1992

Related U.S. Application Data

[63] Continuation-in-part of Ser. No. 576,964, Sep. 4, 1990, Pat. No. 5,121,794.

[51] Int. Cl.[5] ..... E21B 33/08

[52] U.S. Cl. ..... 166/81

[58] Field of Search ..... 166/77.5, 75.1, 81, 166/93, 241.6, 241.7, 243; 175/66, 84, 202, 207–210; 403/335–338, 341, 380; 404/6, 9

[56] References Cited

U.S. PATENT DOCUMENTS

| | | | |
|---|---|---|---|
| 560,986 | 5/1896 | Grow | 166/81 |
| 1,334,678 | 3/1920 | Riley | 166/75.1 |
| 1,357,856 | 11/1920 | Edgecomb | 166/81 |
| 1,390,793 | 9/1921 | Kyle et al. | 166/81 |
| 1,407,791 | 2/1922 | Fowler et al. | 403/336 X |
| 1,418,612 | 6/1922 | Beard | 166/81 |
| 1,507,628 | 9/1924 | Schuyler | 166/88 X |
| 1,651,221 | 11/1927 | O'Maley | 404/6 X |
| 1,836,130 | 12/1931 | Reighner | 166/81 |
| 2,669,467 | 2/1954 | Wolferz | 403/336 X |
| 2,943,682 | 7/1960 | Ingram et al. | 166/81 |
| 3,186,722 | 6/1965 | Johnston | 166/84 X |
| 3,270,810 | 9/1966 | Johnston | 166/81 X |
| 4,029,160 | 6/1977 | Leidvik | 175/210 |
| 4,515,499 | 5/1985 | Furiate | 404/6 |
| 4,665,976 | 5/1987 | Retherford | 166/81 |
| 4,949,784 | 8/1990 | Evans | 166/95 X |
| 5,062,500 | 11/1991 | Miller et al. | 184/106 |
| 5,150,751 | 9/1992 | Burton et al. | 166/93 X |

OTHER PUBLICATIONS

Bowen Hydraulic Tubing Stuffing Box, 1984–1985 Composite Catalog, vol. 1, p. 1125 (World Oil).

Trico Industries, Inc. Double-Pac Stuffing Box, 1984–1985 Composite Catalog, vol. 4, p. 7147 (World Oil).

*Primary Examiner*—Ramon S. Britts

*Assistant Examiner*—Roger J. Schoeppel

*Attorney, Agent, or Firm*—Donald A. Streck; Robert M. Wallace

[57] ABSTRACT

Waste fluid containment and recovery apparatus for installation in-line with a piping system between a pair of horizontal interfacing flanges thereof. There is a pan having a bottom and surrounding sidewalls, the bottom having a bore therethrough. A flange interface having a pair of opposed interfacing surfaces which interface with respective ones of the pair of interfacing flanges is disposed around the bore for sealably connecting the bottom in line with the piping system. The floor can be sloped towards a drain and covered with a horizontal grating floor so that personnel can safely walk within the pan while fluids pass through the floor to the bottom below. Safety railings are removably attached around the sidewalls. One embodiment has support posts adjustably connected at the corners for supporting the pan over a well-head for attachment, removal, and against movement in use.

13 Claims, 4 Drawing Sheets

PORTABLE OIL-DRILLING WASTE RECOVERY SYSTEM

BACKGROUND OF THE INVENTION

This application is a continuation-in-part of application Ser. No. 576,964 filed 4 Sep. 1990, now U.S. Pat. No. 5,121,794, which was issued 16 Jun. 1992.

This invention relates to oil-drilling apparatus and apparatus for environmental protection; and, more particularly, to waste fluid containment and recovery apparatus for installation in-line with a piping system between a pair of horizontal interfacing flanges thereof comprising a pan having a bottom and surrounding sidewalls, the bottom having a bore therethrough and flange interface means having a pair of opposed interfacing surfaces which interface with respective ones of the pair of interfacing flanges disposed around the bore for sealably connecting the bottom in line with the piping system.

In our earlier above-referenced application of which this is a continuation-in-part, we disclosed a waste recovery system for use in oil-drilling as depicted in FIG. 1 wherein a pan 10 having a drain 12 is mounted in-line between a flange 14 of a well-head 16 and flange 15 of an upper fitting 17. The need for such apparatus remains the same as described in detail therein and the descriptions and teachings of that application are incorporated herein by reference.

Since building and testing such apparatus under actual field conditions, however, improvements in the apparatus to make it easier to use and better suited to its intended purpose have become apparent and have been developed in response to the recognized need. This application is directed to those improvements.

Wherefore, the object of this invention is to provide improvements to the basic waste recovery system for oil-drilling of our parent application.

Other objects and benefits of the invention will become apparent from the detailed description which follows hereinafter when taken in conjunction with the drawing figures which accompany it.

SUMMARY

The foregoing object has been achieved by the waste fluid containment and recovery apparatus of this invention for installation in-line with a piping system between a pair of horizontal interfacing flanges thereof comprising, a pan having a bottom and surrounding sidewalls, the bottom having a bore s therethrough; and, flange interface means having a pair of opposed interfacing surfaces which interface with respective ones of the pair of interfacing flanges disposed around the bore for sealably connecting the bottom in line with the piping system.

Preferably, the bottom has a drain pipe connected through the bottom. In one variation, the flange interface means has an inlet to the piping system disposed through a sidewall thereof between respective ones of the pair of opposed interfacing surfaces and a connecting conduit is connected between the drain pipe and the inlet to the piping system.

Also preferably, the bottom is sloped downward from adjacent the sidewalls towards the bore and the bottom has a drain pipe connected through the bottom adjacent the bore. A horizontal grating floor is also disposed over the bottom whereby personnel can walk on the grating floor and waste fluids can pass through the grating floor to the bottom.

Where personnel will be working in the pan at an elevated level, the bottom is rectangular in shape, a plurality of sockets are carried about a periphery of the bottom by the sidewalls, and a plurality of protective railings are removably carried by the sockets. A ladder can also be removably carried by the sockets.

For portability, there is a base carrying and supporting the bottom; a pair of wheels removably carried by the base; and, a pulling tongue removably carried by the base whereby the base with the bottom in combination are pulled as a trailer behind a vehicle to a site for use and then the pair of wheels and the pulling tongue are removed to allow the bottom to be positioned in-line with a piping system.

For support, there is a plurality of guide members carried by the bottom at spaced intervals about a periphery thereof; a plurality of vertical support members removably connected to respective ones of the guide members; and, locking adjustment means for releasably and adjustably attaching the plurality of guide members to respective ones of the plurality of vertical support members at selected vertical heights. In one embodiment, the plurality of guide members each comprises a vertically oriented conduit having a pair of horizontally aligned holes through opposed sidewalls thereof; the plurality of vertical support members are slidably disposed through respective ones of the guide members and each has a plurality of horizontal bores therethrough at spaced vertical heights; and, the locking adjustment means comprises a plurality of pins disposed through respective ones of the horizontally aligned holes and a one of the plurality of horizontal bores. A plurality of hydraulic lifts can also be disposed between respective ones of the guide members and the bottom whereby vertical height of the bottom can be finely adjusted from a vertical position of one of the plurality of horizontal bores with the plurality of hydraulic lifts.

DESCRIPTION OF THE PREFERRED EMBODIMENT

Figures 1, 2:
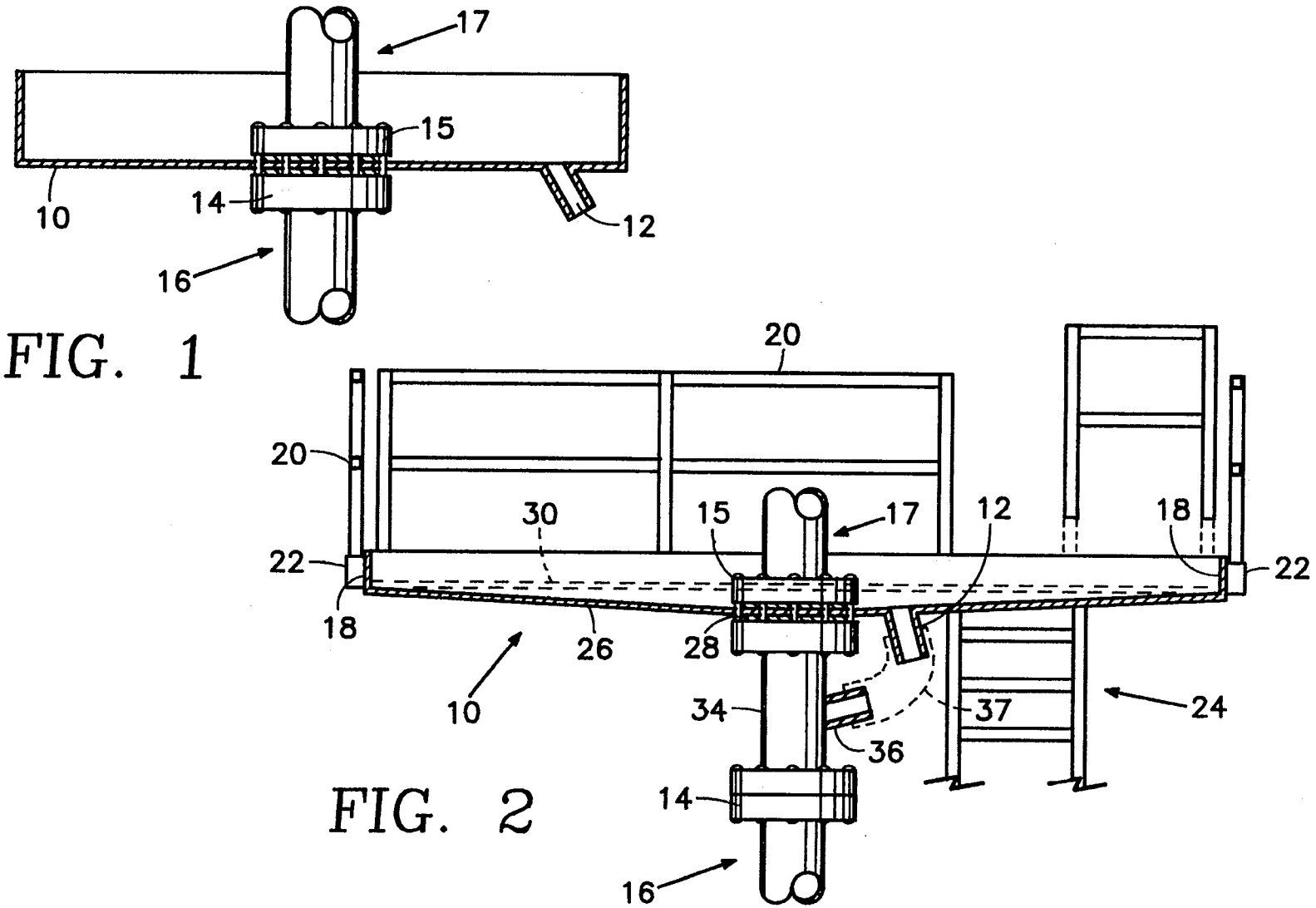
FIG. 1 is a simplified cutaway side view of an oil-drilling waste recovery system as in the parent application of which this is a continuation-in-part.
FIG. 2 is a simplified cutaway side view of an oil-drilling waste recovery system incorporating some of the improvements added thereto by this application.
Figure 3:
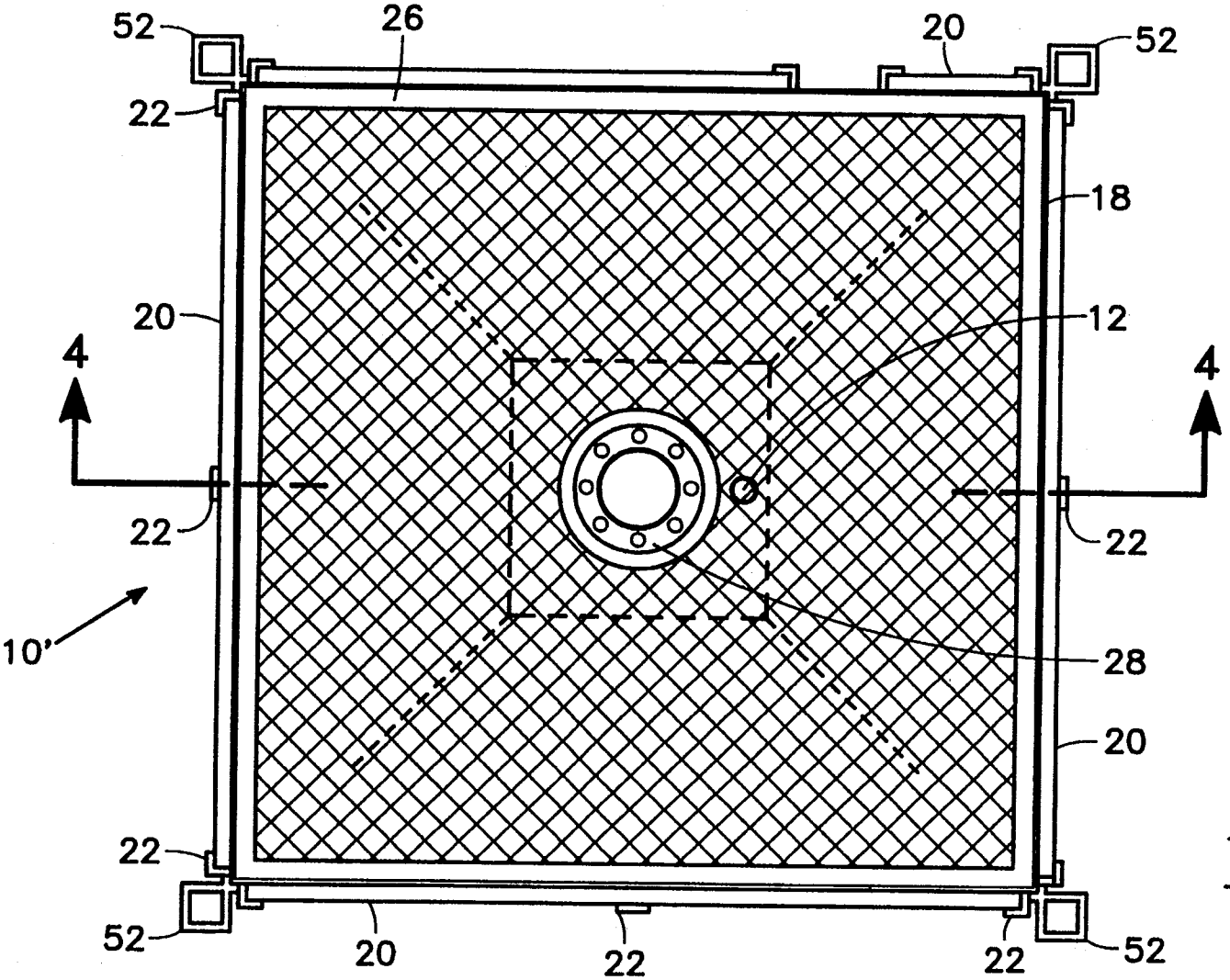
FIG. 3 is a plan view of the apparatus of FIG. 2.

A first set of improvements to the basic waste recovery system of FIG. 1 is depicted in FIGS. 2 and 3. In this regard, the pan 10 of FIG. 1 fully attained its intended objective of catching fluid wastes associated with oil-well drilling under actual operating conditions and was instantly accepted as a viable solution to many environmental contamination problems that had been plaguing the oil-drilling industry for a long time. The actual configuration of the pan 10, however, made its use while personnel were working at the well-head difficult. Thus, the pan was reconfigured to the embodiment of the pan 10' of FIGS. 2 and 3.

As can be seen in FIG. 2 as compared with FIG. 1, the pan 10' is somewhat wider and the sidewalls 18 are lower. More significant, the shape has been changed from round to rectangular. Remembering that the apparatus of this invention must be erected on site in remote locations in many instances with a minimum of equipment available, it was a primary intent in making the improvements being described herein to provide a maximum of useful space and auxiliary features while minimizing the weight of the apparatus. Thus, in keeping with this design criteria, a plurality of safety railing sections 20 are provided and can be removably inserted into sockets 22 welded to the sidewalls 18. Since the pan 10' is typically at an elevated level, for added safety purposes a stairway ladder 24 is also provided which releasably attaches to a pair of the sockets 22 provided for the purpose.

Since oil waste on a smooth metal surface can cause a safety hazard to personnel working in the pan 10', the drain 12 has been moved towards the center of the bottom 26 of the pan 10' and the bottom 26 is sloped downward from the sidewalls 18 towards the center flange connector 28. A level metal mesh floor 30 of the type used for walkways and the like is disposed over the bottom 26 of the pan 10'. This places workmen in the pan above the bottom 26 on a good gripping surface (i.e. the metal mesh floor 30) through which any fluids from above can also pass into the pan 10' below.

Figure 4:
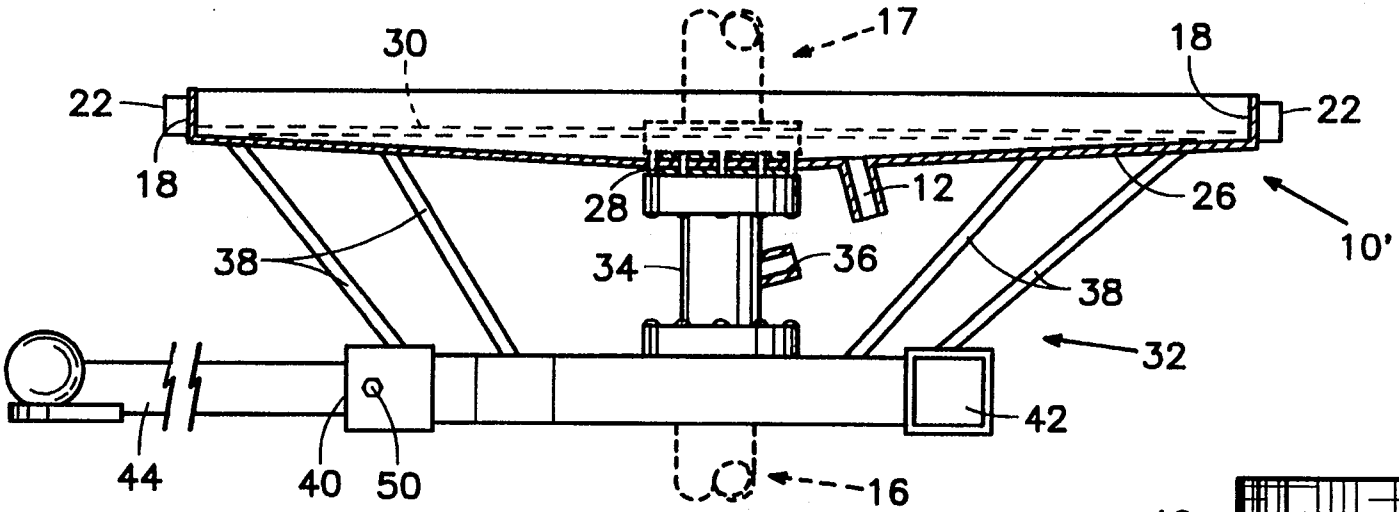
FIG. 4 is a simplified cutaway side view of the waste recovery pan of FIG. 2 with a waste feed-back fitting added thereto mounted on a base for portability.
Figure 5:
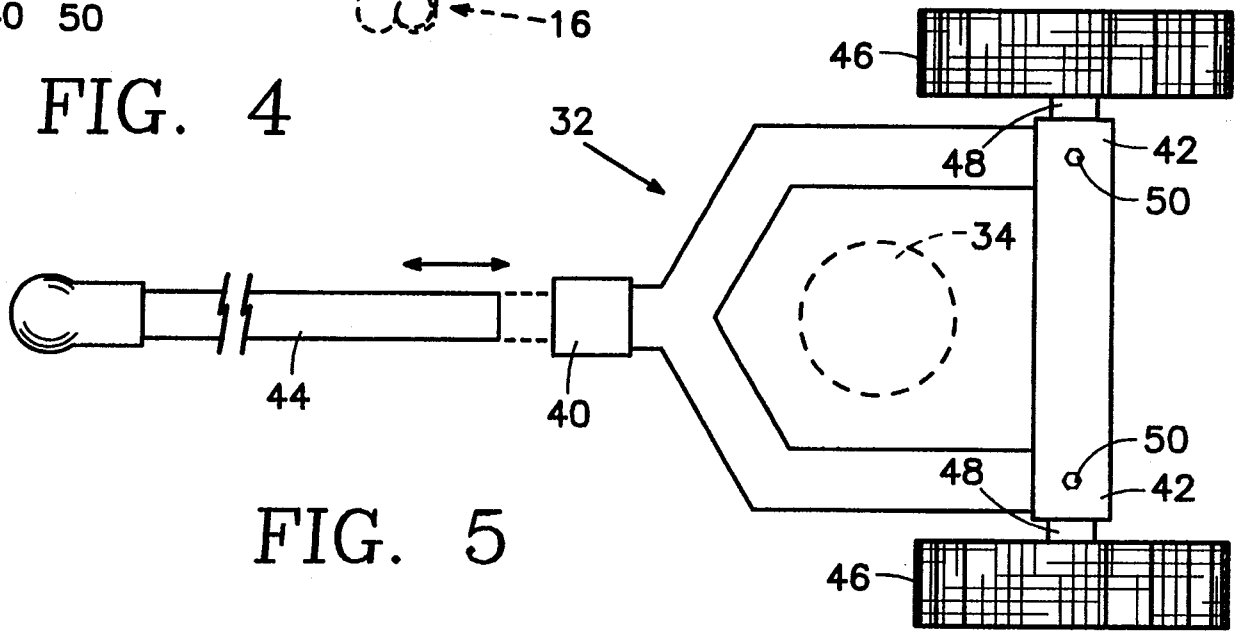
FIG. 5 is a plan view of the base of FIG. 4 depicting how wheels and a trailer tongue can be removably added to the base for portability.

To make the pan 10' (and associated equipment such as the safety railing sections 20 and the stairway ladder 24) more easily transportable to remote drilling sites, the pan 10' can be incorporated into a support base 32 as depicted in FIGS. 4 and 5. An in-line flange connector 34 associated with the pan 10' can also be added incorporating a waste-entry pipe 36. If desired, any fluid wastes entering the drain 12 can be routed into the waste-entry pipe 36 instead of being caught in a separate container requiring separate disposal efforts. This can be accomplished by employing a short connecting hose 37 as shown ghosted in FIG. 3 to a similar waste-entry pipe 36 depicted in that drawing. For stability, the pan 10' can be supported by support bars 38 welded between the pan 10' and the base 32. For portability, the base 32 has a front socket 40 and a pair of wheel sockets 42 into which a tow-bar 44 and a pair wheels 46 on axles 48 can be inserted, respectively, and held in place by bolts or pins 50. With the tow-bar 44 and wheels 46 fastened in place, the base 32 and pan 10' can be towed as a trailer to any drilling site with the safety railing sections 20 and the stairway ladder 24 in the pan 10'. Once at the site, the tow-bar 44 and wheels 46 can be removed for convenience and to reduce weight prior to erection.

Figure 6:
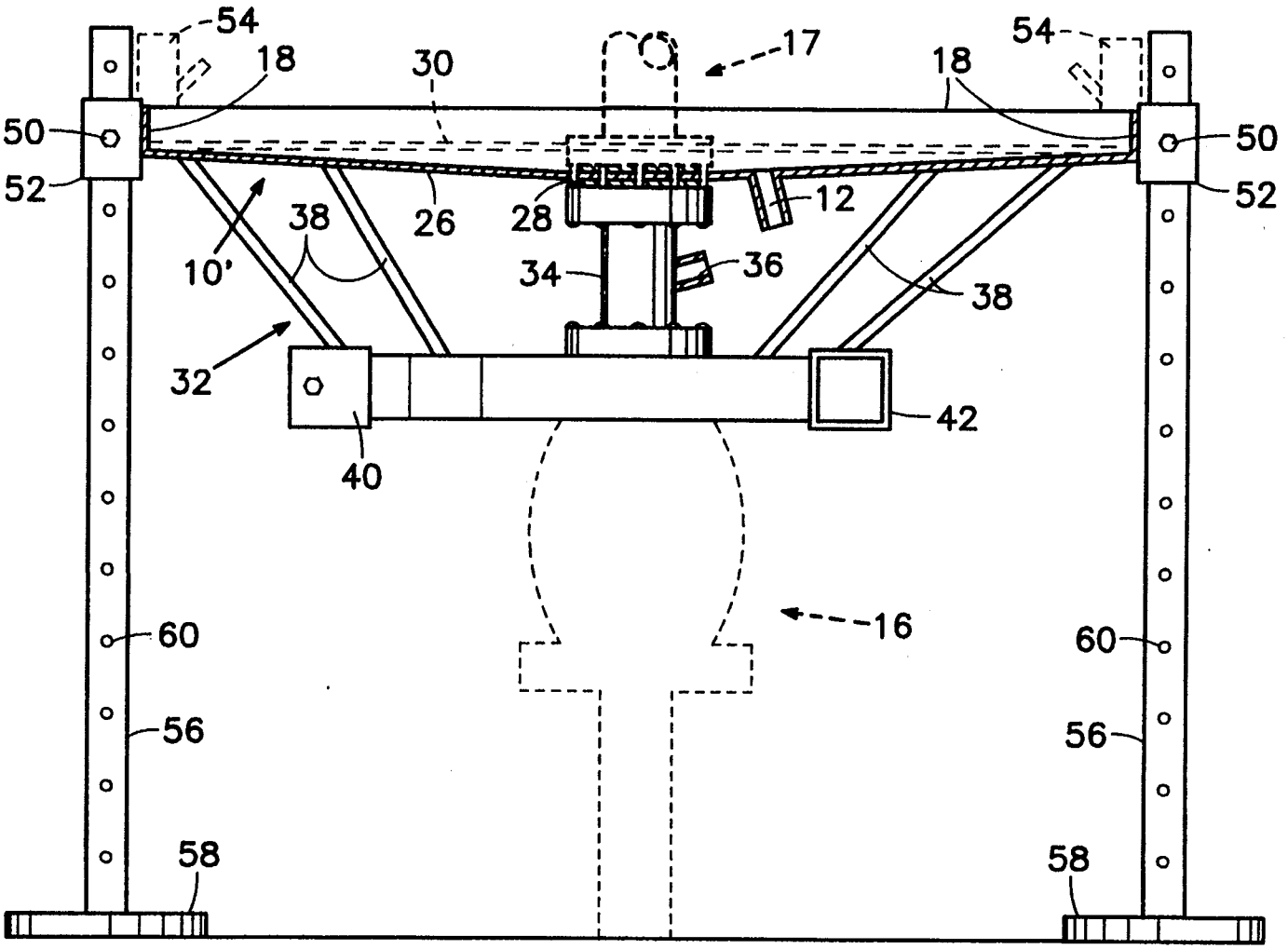
FIG. 6 is a simplified cutaway side view of the apparatus of FIG. 5 with the addition of supporting apparatus by means of which the waste recovery apparatus can be lifted and positioned over a well-head for attachment purposes.

As can be seen from the plan view of FIG. 3, support collars 52 can be provided at the four corners of the pan 10' by bolting or welding them to the sidewalls 18. As depicted in FIG. 6, the support collars 52 can then be used to lift and hold the pan 10'. If desired, small hydraulic lifts (as shown ghosted at 54) can be employed between the support collars 52 and the pan 10' to provide a fine adjustment and lifting capability to the pan 10'. In general, the support collars 52 are supported by associated support columns 56 extending upward from bases 58 through the support collars 52 with bolts or pins 50 passing through holes 60 provided in the support columns 56 for the purpose. In this regard, as those skilled in the art will appreciate, the construction of the support columns 56 adjustably supporting the pan 10' (with or without the optional hydraulic lifts 54) is similar to the support equipment used to support and level camper shells and the like. Accordingly, the same equipment can undoubtedly be obtained and modified for the purpose to simplify implementation of this aspect of this invention.

As can be appreciated, the foregoing support structure in combination with the portable base makes the waste recovery apparatus of the inventors herein as modified by these improvements very simple and easy to use thus promoting its use for the benefit of the environment. The pan 10' and its associated equipment can be towed to a drilling site behind a pickup truck. Once the tow-bar 44 and wheels 46 have been removed and the equipment removed from the pan 10' the pan 10' can be positioned on the support columns 56 over the well-head 16. The pan 10' and in-line flange connector 34 can then be lowered, positioned, and re-positioned as necessary using the hydraulic lifts 54 until proper alignment is attained and the pan 10' and in-line flange connector 34 bolted in place. At that point, the safety railing sections 20 and the stairway ladder 24 can be installed into their sockets 22 and the entire apparatus is ready for use. Dis-assembly and removal from the site is simply a reverse of the foregoing procedure.

Wherefore, having thus described the present invention,

What is claimed is:

1. Waste fluid containment and recovery apparatus for installation in-line with a piping system between a pair of horizontal interfacing flanges thereof comprising:

a) a pan having a bottom and surrounding sidewalls, said bottom having a bore therethrough;

b) flange interface means having a pair of opposed interfacing surfaces which interface with respective ones of the pair of interfacing flanges disposed around said bore for sealably connecting said bottom in line with the piping system;

c) a plurality of guide members carried by said bottom at spaced intervals about a periphery thereof;

d) a plurality of vertical support members removably connected to respective ones of said guide members; and, e) locking adjustment means for releasably and adjustably attaching said plurality of guide members to respective ones of said plurality of vertical support members at selected vertical heights.

2. The waste fluid containment and recovery apparatus of claim 1 wherein:

a) said plurality of guide members each comprises a vertically oriented conduit having a pair of horizontally aligned holes through opposed sidewalls thereof;

b) said plurality of vertical support members are slidably disposed through respective ones of said guide members and each has a plurality of horizontal bores therethrough at spaced vertical heights; and, c) said locking adjustment means comprises a plurality of pins disposed through respective ones of said horizontally aligned holes and a one of said plurality of horizontal bores.

3. The waste fluid containment and recovery apparatus of claim 1 and additionally comprising:

a) a plurality of hydraulic lifts disposed between respective ones of said guide members and said bottom whereby vertical height of said bottom can be finely adjusted from a vertical position of one of said plurality of horizontal bores with said plurality of hydraulic lifts.

4. Portable waste fluid containment and recovery apparatus for installation in-line with a piping system between a pair of horizontal interfacing flanges thereof comprising:

a) a pan having a bottom and surrounding sidewalls, said bottom having a bore therethrough and being sloped downward from adjacent said sidewalls towards said bore;

b) flange interface means having a pair of opposed interfacing surfaces which interface with respective ones of the pair of interfacing flanges disposed around said bore for sealably connecting said bottom in line with the piping system;

c) a drain pipe connected through said bottom adjacent said bore;

d) a horizontal grating floor disposed over said bottom whereby personnel can walk on said grating floor and waste fluids can pass through said grating floor to said bottom;

e) a base carrying and supporting said bottom;

f) a pair of wheels removably carried by said base; and, g) a pulling tongue removably carried by said base whereby said base with said bottom in combination are pulled as a trailer behind a vehicle to a site for use and then said pair of wheels and said pulling tongue are removed to allow said bottom to be positioned in-line with a piping system.

5. The waste fluid containment and recovery apparatus of claim 4 wherein:

a) said flange interface means has an inlet to the piping system disposed through a sidewall thereof between respective ones of said pair of opposed interfacing surfaces; and additionally comprising, b) a connecting conduit connected between said drain pipe and said inlet to the piping system.

6. The waste fluid containment and recovery apparatus of claim 4 wherein:

a) said bottom is rectangular in shape; and additionally comprising, b) a plurality of sockets carried about a periphery of said bottom by said sidewalls; and, c) a plurality of protective railings removably carried by said sockets.

7. The waste fluid containment and recovery apparatus of claim 4 and additionally comprising:

a) a plurality of guide members carried by said bottom at spaced intervals about a periphery thereof;

b) a plurality of vertical support members removably connected to respective ones of said guide members; and, c) locking adjustment means for releasably and adjustably attaching said plurality of guide members to respective ones of said plurality of vertical support members at selected vertical heights.

8. The waste fluid containment and recovery apparatus of claim 7 wherein:

a) said plurality of guide members each comprises a vertically oriented conduit having a pair of horizontally aligned holes through opposed sidewalls thereof;

b) said plurality of vertical support members are slidably disposed through respective ones of said guide members and each has a plurality of horizontal bores therethrough at spaced vertical heights; and, c) said locking adjustment means comprises a plurality of pins disposed through respective ones of said horizontally aligned holes and a one of said plurality of horizontal bores.

9. The waste fluid containment and recovery apparatus of claim 7 and additionally comprising:

a) a plurality of hydraulic lifts disposed between respective ones of said guide members and said bottom whereby vertical height of said bottom can be finely adjusted from a vertical position of one of said plurality of horizontal bores with said plurality of hydraulic lifts.

10. Supported and vertically adjustable waste fluid containment and recovery apparatus for installation in-line with a piping system between a pair of horizontal interfacing flanges thereof comprising:

a) a pan having a bottom and surrounding sidewalls, said bottom having a bore therethrough and being sloped downward from adjacent said sidewalls towards said bore;

b) flange interface means having a pair of opposed interfacing surfaces which interface with respective ones of the pair of interfacing flanges disposed around said bore for sealably connecting said bottom in line with the piping system;

c) a drain pipe connected through said bottom adjacent said bore;

d) a horizontal grating floor disposed over said bottom whereby personnel can walk on said grating floor and waste fluids can pass through said grating floor to said bottom;

e) a plurality of guide members carried by said bottom at spaced intervals about a periphery thereof;

f) a plurality of vertical support members removably connected to respective ones of said guide members; and, g) locking adjustment means for releasably and adjustably attaching said plurality of guide members to respective ones of said plurality of vertical support members at selected vertical heights.

11. The waste fluid containment and recovery apparatus of claim 10 wherein:

a) said plurality of guide members each comprises a vertically oriented conduit having a pair of horizontally aligned holes through opposed sidewalls thereof;

b) said plurality of vertical support members are slidably disposed through respective ones of said guide members and each has a plurality of horizontal bores therethrough at spaced vertical heights; and, c) said locking adjustment means comprises a plurality of pins disposed through respective ones of said horizontally aligned holes and a one of said plurality of horizontal bores.

12. The waste fluid containment and recovery apparatus of claim 10 and additionally comprising:

a) a plurality of hydraulic lifts disposed between respective ones of said guide members and said bottom whereby vertical height of said bottom can be finely adjusted from a vertical position of one of said plurality of horizontal bores with said plurality of hydraulic lifts.

13. The waste fluid containment and recovery apparatus of claim 10 wherein:

a) said bottom is rectangular in shape; and additionally comprising, b) a plurality of sockets carried about a periphery of said bottom by said sidewalls; and, c) a plurality of protective railings removably carried by said sockets.

* * * * *